United States Patent [19]

Meyer et al.

[11] Patent Number: 4,617,693

[45] Date of Patent: Oct. 21, 1986

[54] DRAIN PIPE CLEANING TOOL

[76] Inventors: Marjorie A. Meyer, 19711 NE. 21 Ct., North Miami Beach, Fla. 33179; John D. Moore, 2685 NE. 188 St., North Miami Beach, Fla. 33180

[21] Appl. No.: 783,510

[22] Filed: Oct. 3, 1985

Related U.S. Application Data

[63] Continuation-in-part of Ser. No. 637,805, Aug. 6, 1984, abandoned.

[51] Int. Cl.[4] ..... B08B 9/02

[52] U.S. Cl. ..... 15/104.3 SN

[58] Field of Search ..... 15/104.3 R, 104.3 SN; 254/134.3 FT

[56] References Cited

U.S. PATENT DOCUMENTS

| | | | |
|---|---|---|---|
| 1,842,166 | 1/1932 | Haines | 15/104.3 SN |
| 2,037,103 | 4/1936 | Yohn | 15/104.3 SN |
| 3,574,878 | 4/1971 | Shames et al. | 15/104.3 SN |
| 4,317,247 | 3/1982 | Levine | 15/104.3 SN |
| 4,340,988 | 7/1982 | Shames et al. | 15/104.3 SN |

FOREIGN PATENT DOCUMENTS

| | | | |
|---|---|---|---|
| 2117078 | 10/1983 | United Kingdom | 15/104.3 SN |

*Primary Examiner*—Edward L. Roberts
*Attorney, Agent, or Firm*—John C. Malloy

[57] ABSTRACT

A drain cleaning assembly including a housing for storing an elongated flexible material auger type cable mounted in surrounding relation about a rotatable drum of the housing and positionable between an operable and a stored position through rotation of the drum relative to the housing. A handle disposed in substantially coplanar relation to the housing and extending outwardly from a periphery thereof is movable relative to the housing such that rotation of the housing relative to the handle causing rotation of the cable about its own longitudinal axis due to a fixed connection of the cable on the interior of the housing.

18 Claims, 5 Drawing Figures

DRAIN PIPE CLEANING TOOL

BACKGROUND OF THE INVENTION

This is a continuation-in-part application of copending U.S. patent application Ser. No. 637,805 filed Aug. 6, 1984, now abandoned.

FIELD OF THE INVENTION

Prior art structures relating to auger type or snake coils maintained within a housing and extendable outward therefrom into an operable position for cleaning a drain, commode, etc. are quite well known in the prior art. Typically, prior art devices, in order to retain a coil wire or "snake" in lengths normally up to 25 feet incorporate a magazine or housing of some sort. In commercial as versus domestic units, coil structures up to 150 feet may be used with a drive motor or auxiliary power device such as a standard hand-held operated drill. Such prior art devices further include a pistol type grip secured to the housing and extending outwardly therefrom in substantially perpendicular relation to the "plane" of the housing. While operable for certain intended applications, a magazine or cannister having its plane perpendicular to the axis of the cable incorporates considerable bulk which is not advantageous for storage or packaging.

A typical package involves approximately 550 to 750 cubic inches for the packaging of a manually operated unit. Displaying and orienting such a packaged unit on shelves or support rods in an attractive manner is difficult for the prior art bulky unit. It is highly desirable for this type of product, as well as most other products, to display the packaging in an attractive manner. Accordingly, it is advantageous to reduce the bulk and orient the overall configuration of the unit such that a plurality of such packaged units may be arranged in side-by-side, adjacent, stacked or vertically oriented relation to one another.

Structures of the type referred to herein are disclosed in the following U.S. Pat. Nos. 3,283,253; 3,574,878; and D-238,046. In addition to these patents, the U.S. Pat. Nos. 1,842,166, Haines; 2,037,103Yohn; 3,574,878, Shames; and 4,340,988, Shames; and 4,317,247, Levine. Also, British patent application No. 2,117,078 relates to a drain cleaning device. Of the above, Levine and Shames ('988) both relate to an outwardly extending grip-type construction; Shames ('878) relates to a power driven apparatus using an auxiliary hand drill and Haynes, Yohn and the British reference cited above all relate to a substantially flat type construction but with outwardly protruding handles secured thereto for operative positioning of the cable from within the interior of a housing.

Accordingly, there is a need in the prior art for a drain cleaning assembly having a compact packaging configuration for pleasing display of the articles as well as being effectively and efficiently structured for use.

SUMMARY OF THE INVENTION

The present invention relates to a "snake" or auger type drain cleaning assembly wherein an elongated coil of flexible material is maintained within a housing and positionable relative to the interior of the housing between an operable position and a stored position. The stored position of the cable is defined by the vast majority of its length wound about a support surface of a centrally disposed, rotatably mounted drain. Alternately, the operable position of the cable is defined by extending the free end thereof, having an enlarged cleaning head affixed thereto, outwardly from the interior of the casing and into or along the length of the clogged drain or like plumbing facilities needed to be cleaned.

The housing of the assembly is specifically structured to have a substantially flat configuration defined by spaced apart substantially lateral faces. An elongated barrel protrudes outwardly from a peripheral cylindrically configured surface or face interconnecting the two lateral faces so as to provide direction or channelling of the cable as it enters and leaves the housing when being positioned between the stored and operable positions.

A handle means in the form of an elongated hollow sleeve is disposed in movable, surrounding and substantially concentric relation to the barrel. The handle sleeve is affixed to the barrel so as to be movable relative to the housing.

Accordingly, the cleaning cable can be effectively manipulated to accomplish cleaning of the drain or plumbing conduit in question. More specifically, the cleaning cable is moved outwardly from the interior of the housing along the length of the drain conduit to be cleaned by rotation of the drum relative to the housing. Also, in order to free any clogged debris, etc. within the drain, the fixed cleaning head attached to the free end of the cable may be rotated about its own longitudinal axis, as well as the cable itself. This occurs by manual rotation of the entire housing relative to the handle sleeve after the cable is disposed in its outwardly extended or operable position. Such rotation is facilitated by further securing the cable, at a point along its length, to the barrel, preferably at the free end thereof, by a conventional turn screw or like clamp structure.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
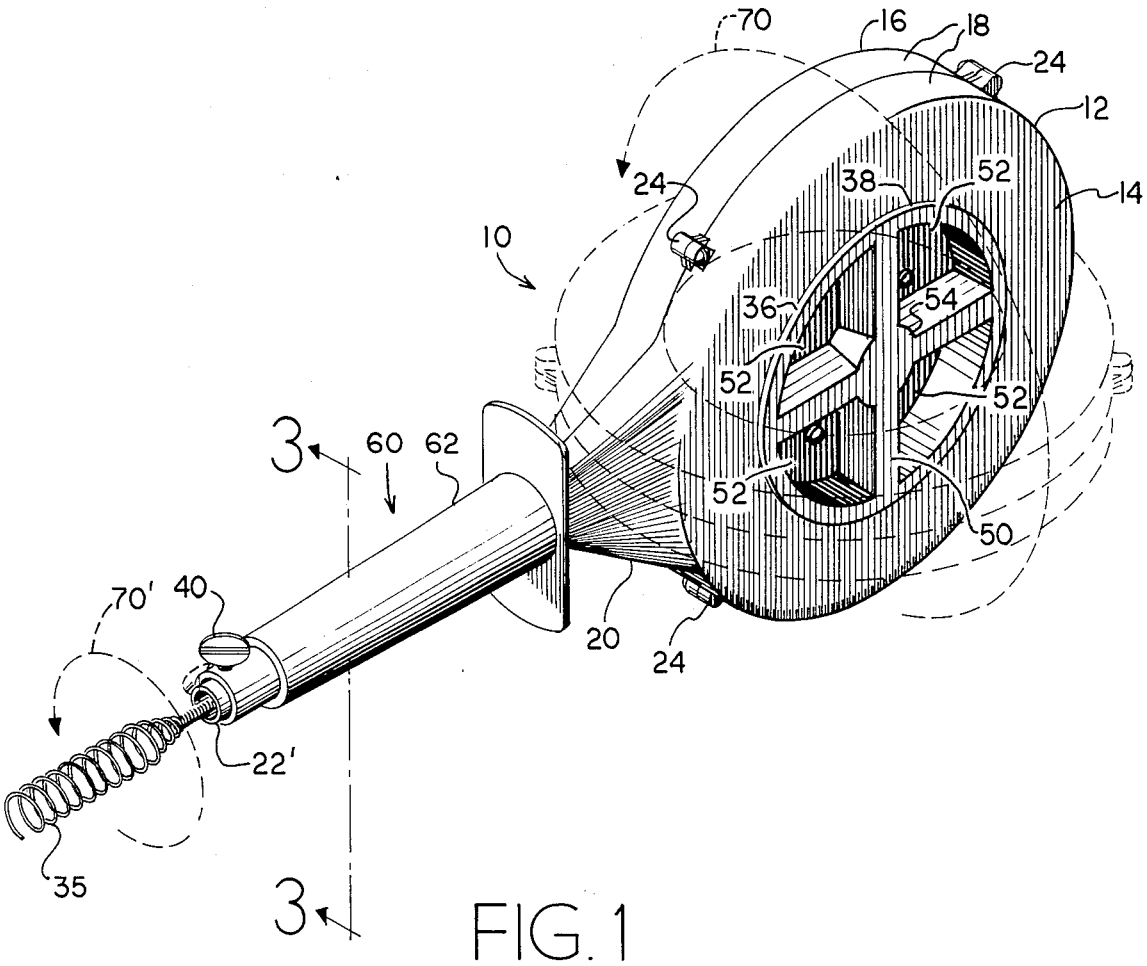
FIG. 1 is an isometric view of the assembly of the present invention wherein rotational orientation or positions of the housing relative to handle portion of the assembly is represented in broken lines.

As shown in FIGS. 1 through 4, the present invention is directed towards a cleaning assembly for a drain or like facility which is generally indicated as 10 and includes a housing. The housing 12 is defined by two housing portions each of which includes a lateral face 14 and 16 disposed in spaced apart and substantially parallel relation to one another. Each of the lateral faces 14 and 16 include a substantially cylindrical or semi-circular shaped continuous peripheral surface 18 disposed in interconnecting relation between the lateral surfaces. Further, a nose-shaped funnel 20 tapers into an elongated barrel 22. The aforementioned structures are, in a preferred embodiment, manufactured by forming two equally dimensioned and structured housing halves secured together along a commonly disposed peripheral edge by connector mounts 24. Such connector mounts 24 are specifically structured to receive conventional connectors such as nut and bolt type fasteners etc.

Figure 2:
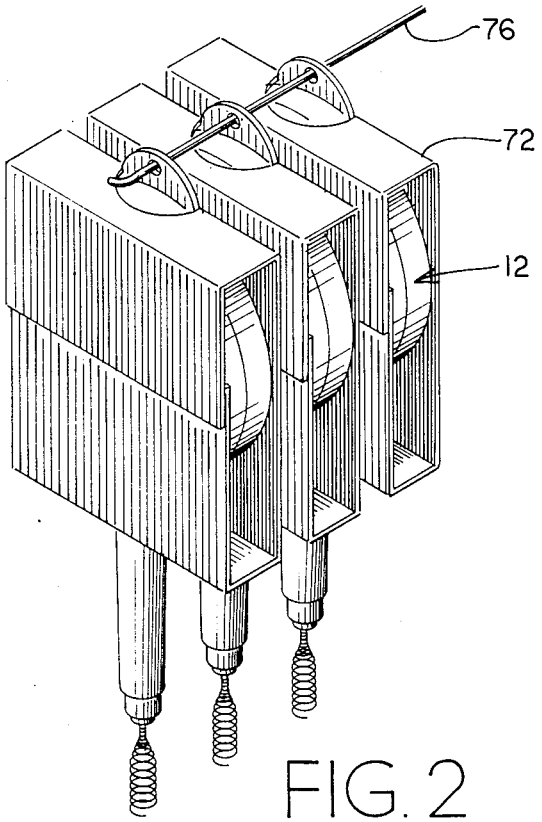
FIG. 2 is an isometric view of a stacked array of packaged assemblies made possible due to the specific preferred configuration of each of the assemblies.
Figure 3:
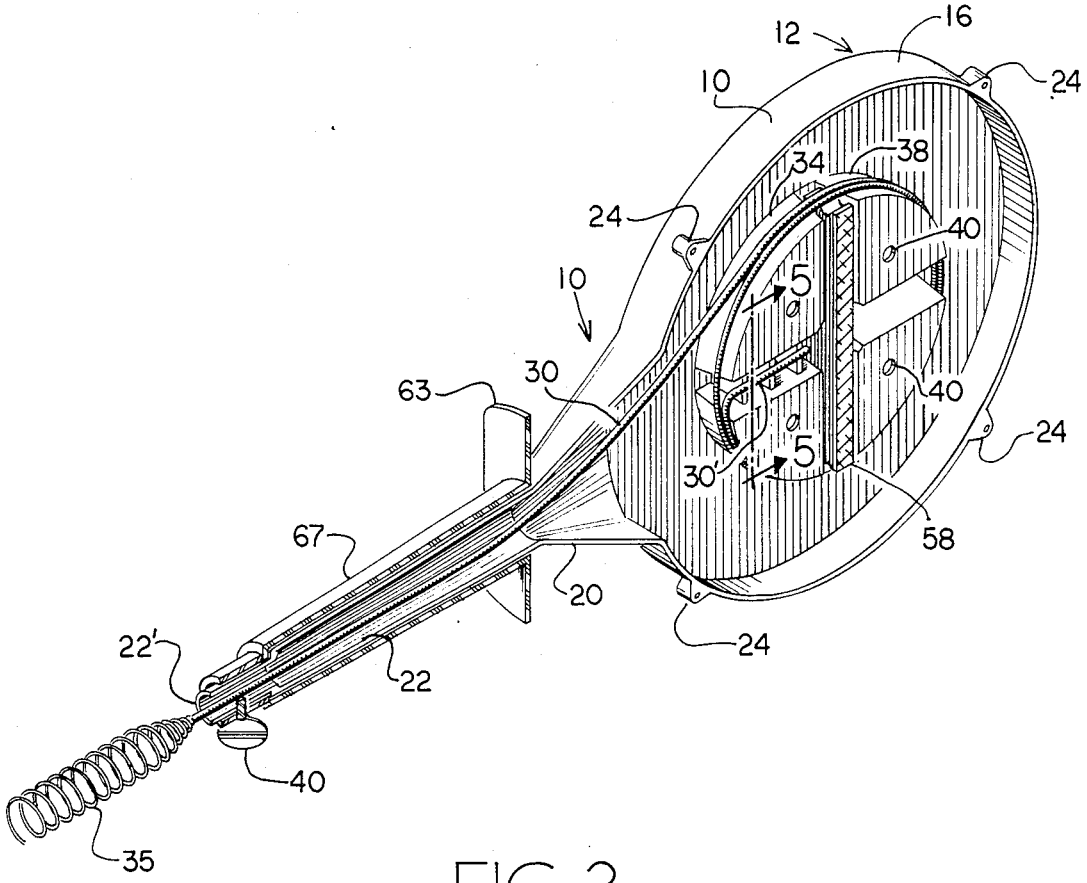
FIG. 3 is an isometric view in partial section of the interior of the housing of the assembly showing structural components of the assembly including a cleaning cable disposed in its stored position.

As shown in FIGS. 2 and 3, the funnel-type nose portion 20 serves as a guide to effectively channel elongated cleaning calbe 30 as it travels between a stored position and an operable position relative to the interior of the housing 12. The referred to stored position is define by the cable 30 having its length wound about and supported on a support surface 34 of a drum rotatably mounted on the interior of the housing.

The drum comprises two correspondingly structured and configured end portions 36 each passing through a substantially centrally formed aperture 38 in each of the lateral faces 14 and 16. The resulting drum is defined by the inner surfaces of each end portion 36 brought into interconnected relation to one another. Such interconnection is accomplished by a plurality of connector apertures 40 through which are received and mounted conventional connectors such as screws, nut and bolt, etc. By virtue of such interconnection, and the respective end portions 36 aligned with and accessible through central apertures 38 in each of the lateral faces 14 and 16, the defined drum on which cable 30 is mounted is rotatable relative to the housing 12 by rotation of either of the end pieces accessible on either of the lateral faces 14 and/or 16.

Figure 5:
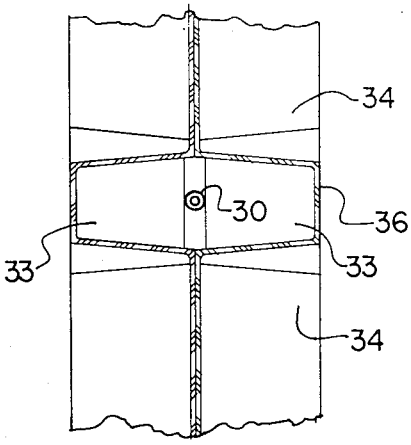
FIG. 5 is a detailed view along line 5—5 of FIG. 3 in partial section showing structural features which enable the fixed positioning or connection of an interior end of the cleaning cable within the housing.

The cable 30 is secured on the interior of the housing 12 by virtue of its innermost end 30' being secured or gripped between gripping elements or teeth 33 of each outside end 36 clamping, innermost end 30' therebetween as clearly shown in FIGS. 3 and 5.

It is readily apparent therefore that rotation of the drum in opposite directions causes the cleaning cable 30 to be positioned in its stored position as shown in FIG. 3 or its operable position. The operable position may be accurately defined as cleaning cable 30 extending outwardly from the housing 12 and the free end 22' of the barrel 22. A sufficient length of the cable 30 must extend therefrom so as to pass through a drain to be cleaned (not shown) such that the fixed and enlarged cable head 35 comes in contact wlth an obstruction or area of the draining pipe or conduit which is to be removed or cleaned. Once the cable 30 and head 35 are positioned in its operable position and in contact with the area of the drain pipe to be cleaned, such cable may be additionally secured to the housing. The barrel 22 includes a thumb screw or clamping element 40 mounted thereon and forcing the cable 30 into fixed, frictional engagement with an interior surface of the barrel 22, as is well known in the art. (See FIG. 3).

Another important feature of the present invention is the positioning means secured to the drum on the interior of one of the outwardly extending gripping flanges 50. As set forth above, each of the outside opposite ends 36 of the drum are rotatably mounted at least partially on the interior of the housing 12 by passing through oppositely disposed and aligned apertures 36 formed in the respective lateral sides 14 and 16. Further, the exposed face of each of these end portions 36 includes a recessed construction including a plurality of pockets 52 defined by outwardly extending gripping flanges 50. Such is clearly shown in FIG. 1.

Figure 4:
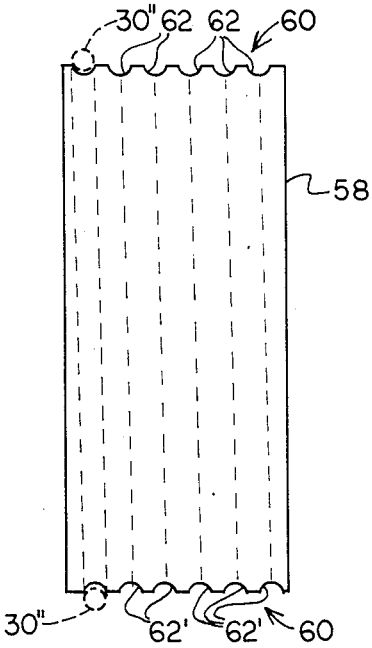
FIG. 4 is a front plan view of a positioning structure associated with a drum within the interior of the housing for properly positioning cable segments of the cable wound about the supporting drum therefor.

With reference to FIG. 3, each of the flanges 50 which extend radially outward from a center spoke or hub of the recessed construction 54 have hollow interior portions as at 56. At least one of the flanges includes a hollow interior portion 56 having a positioning means 58 mounted therein and effectively secured between the two end portions 36 as they are joined together. Such positioning means or positioning structure 58 has opposite extremities defining engaging portions 60. Each engaging portion 60 has a substantially grooved configuration defined by a plurality of aligned, successively positioned grooves 62 and 62'. With reference to FIGS. 3 and 4, it is readily seen that each of the grooves 62 and 62' are structured, disposed and configured to receive one cable segment 30'' and position such segment in proper, adjacent, side-by-side relation to one another. Further, the grooves 62 and 62' located at opposite extremities of the positioning structure 58 are slightly offset so as to provide a clear, uncluttered surrounding orientation of the cable 30 and, more particularly, the cable segments 30'' in surrounding relation about the drum.

Operation of the assembly and more specifically manipulation of the cable 30 and cable head 35 is as follows. Axial movement of the cable 30 into and out of the housing 12 is accomplished by rotation of the drum. The drum in turn is rotated by a hand passing into the pockets 52 defined within the recessed construction of the exposed face of each of the ends 36 defining the drum. Further, the radially extending flanges 50 may be gripped so as to rotate the drum and thereby move the cable 30 between an outwardly extended or operable position or an inwardly wound or stored position dependent upon the desire of the user. However, once the cable 30 and cleaning head 35 is in its operable position, the clamp or thumb screw 40 is tightened so as to secure the cable on the interior surface of the barrel 22. Once so secured, the cable may be rotated axially about its own longitudinal axis merely by gripping the handle means 60 and turning the housing relative thereto. The handle means 60 comprises an elongated hollow sleeve 62 disposed in surrounding and movable engagement and substantially concentric relation to the barrel 22. Accordingly, the handle sleeve 62 is movable relative to the housing. By virtue of this construction, the handle sleeve is gripped solidly and the housing 12 is turned in either direction as indicated in FIG. 1. This in turn serves to rotate the barrel 22 and the cable 30 and cleaning head 35 extending outwardly from the barrel as demonstrated by the rotational directional arrows 70 and 70' of FIG. 1.

Retraction or positioning of the cable into its stored position is accomplished by loosening the thumb screw 40 and rotating the drum, through gripping of the flanges 50, in the opposite direction. This causes the cable to pass back into the interior of the housing in surrounding relation to the support surface 34 of the drum and into orienting position relative to the positioning structure 58 and the grooved configuration 62 and 62'.

Finally, the flat configuration of the assembly including the outward extension of barrel 22 and handle means respectively allows compact packaging of the assembly 12. As shown in FIG. 2, packages 72 may be arranged in a stacked orientation into an immediate side-by-side relation to one another such as being vertially oriented on a supporting rod or the like 74.

It is therefore to be understood that the following claims are intended to cover all of the generic and specific features of the invention herein described, and all statements of the scope of the invention which as a matter of language, might be said to fall therebetween.

Now that the invention has been described,

What is claimed is:

1. A drain cleaning assembly of the type including a coil structure extendable axially along a length of the drain being cleaned and rotatable therein, said assembly comprising:

(a) a housing comprising an at least partially hollow interior and including two spaced apart lateral faces disposed in substantially parallel relation to one another and a continuous substantially cylindrical peripheral surface connected between said lateral faces and defining a peripheral boundary thereof, (b) an elongated barrel structure mounted on said housing and secured to and extending outwardly from said peripheral surface in a direction substantially parallel to said lateral faces, (c) a drum mounted on said housing interior and being rotatable about its own central axis and including a support surface formed about an outer periphery of said drum, (d) said drum having at least one end portion thereof being physically accessible on one of said lateral faces, said end portion rotatable with a remaining portion of said drum, whereby rotation of said end portion causes rotation of said drum, (e) a cleaning cable having an elongated configuration and formed of flexible material having one end secured on the interior of said housing, said cable movable between a stored position and an operable position, (f) said stored position defined by said cable being wound on said drum about said support surface on said housing interior, and said operable position being defined by a length of said cable adjacent a free end thereof extending outwardly from a free end of said barrel structure, (g) handle means for holding said assembly and being connected to said housing and structured to allow relative movement between said housing and said handle means, (h) said cable rotatable along its length upon rotation of said housing relative to said handle means and movable between said stored and said operable positions upon rotation of said drum relative to said housing.

2. An assembly as in claim 1 wherein said handle means comprises an elongated sleeve having a hollow interior and movably disposed in surrounding, substantially concentric relation to said barrel.

3. A assembly as in claim 2 wherein said handle means comprises a stop flange secured to said sleeve adjacent one end thereof and extending outwardly therefrom in transverse relation to the length of said sleeve.

4. An assembly as in claim 1 further comprising a positioning means for orienting cable segments relative to one another on said support surface and surrounding relation to said drum.

5. An assembly as in claim 4 wherein said positioning means comprises a positioning structure mounted on said drum in transverse relation to said support surface, said positioning structure including an engaging portion protruding outwardly from said support surface, said engaging portion configured to orient said cable segments in substantially adjacent, side-by-side relation to one another and in surrounding relation to said drum.

6. An assembly as in claim 5 wherein said positioning structure comprises a plurality of engaging portions each disposed in transverse relation to the length of said support surface and projecting upwardly therefrom into engaging relation with said cable segments, said plurality of engaging portions disposed in spaced relation to one another along the length of said support surface.

7. An assembly as in claim 6 wherein each of said engaging portions includes a plurality of aligned, successively positioned groove structures positioned and structured to receive individual cable segments and thereby align said cable segments in adjacent, side-by-side relation to one another in surrounding relation to said drum.

8. An assembly as in claim 1 wherein each of said lateral faces comprises an aperture formed therein; said drain comprising two end portions wherein at least one of said end portions being disposed in aligned relation to each of said apertures and physically accessible therethrough for manual rotation thereof and of said drum.

9. An assembly as in claim 8 wherein each end portion comprises an exposed face accessible through said respective aperture and including a recessed construction disposed inwardly into said housing from said respective lateral faces, said exposed face further comprising at least one flange formed in said recessed construction so as to move with said respective end portion and project outwardly from said recessed construction for gripping by a hand of a user, whereby rotation of said one flange causes rotation of said end portion and said drum.

10. An assembly as in claim 9 wherein said plurality of flanges are fixedly mounted in said recessed construction in spaced relation to one another, said plurality of gripping flanges extending radially outward from an axis of rotation of said end portion and thereby defining a plurality of pockets, each pocket disposed between adjacent flanges and collectively defining, along with said plurality of flanges, an array which comprises a gripping structure on each end piece.

11. An assembly as in claim 9 wherein said one flange comprises a substantially hollow interior portion, a positioning means for orienting cable segments of said cleaning cable about said support surface of said drum and being mounted within a hollow interior portion of said one flange, said positioning means including at least one positioning structure mounted on said drum in transverse relation to said support surface, said positioning structure including an engaging portion protruding outwardly from said support surface, said engaging surface configured to orient said cable segments into substantially adjacent, side-by-side relation to one another.

12. An assembly as in claim 11 wherein said positioning structure comprises a plurality of engaging portions each disposed in transverse relation to said support surface and projecting outwardly therefrom into engaging relation with said cable segments, said plurality of engaging portions disposed in spaced relation to one another along the length of said support surface.

13. An assembly as in claim 12 wherein said positioning structure comprises a one piece construction having oppositely disposed longitudinal ends each of which define one of said plurality of engaging portions, each of said engaging portions including a plurality of groove structures disposed in aligned, successive relation to one another and extending transverse to said support surface, each of said groove structures disposed and configured to receive one of said cable segments and thereby orient said cable in surrounding relation to said drum.

14. An assembly as in claim 8 wherein a clamp structure is formed on said drum and comprises at least two oppositely disposed clamping elements each of which is formed on one of said end portions of said drum, said clamping elements disposed in aligned, spaced apart relation to one another when said end portions are fixed together and in clamping engagement with an end of said cable disposed on the interior of said housing.

15. An assembly as in claim 1 wherein said drum comprises two end portions each having an exposed face and structured for fixed interconnection to one another, a channel formed at least partially on the interior of said drum and defined by hollow interiors of said two end portions disposed in aligned corresponding relation to one another, said exposed face of each end portion being aligned with an integrally formed aperture in a correspondingly positioned one of said lateral side, each of said exposed faces physically accessible through said aperture of said respective lateral face for rotation of said drum through gripping of either of said exposed faces.

16. An assembly as in claim 15 further comprising a positioning structure formed in said channel at least partially on the interior of said drum, said positioning structure comprising a one piece construction having oppositely disposed longitudinal ends each of which define an engaging portion, each of said engaging portions including a plurality of groove structures disposed in aligned, successive relation to one another and extending transverse to said support surface, said engaging portions disposed in spaced apart relation to one another along the periphery of said drum, each of said groove structures disposed and configured to receive one of said cable segments and thereby orient said cable in surrounding relation to said drum.

17. A magazine type retainer for a plumber's auger comprising:

(a) a cannister assembly comprising a hollow interior portion defined by two semi-circular cannister portions joined together along a commonly disposed and configured periphery, (b) an aperture formed on opposite lateral sides of said formed cannister assembly, said apertures of each lateral side disposed in spaced apart and aligned relation to one another, (c) a drum rotatably mounted at least partially on the interior of said cannister assembly and defined by two drum halves fixed to one another, each drum half having an exposed outer end mounted in aligned relation to a respectively positioned one of said apertures, said exposed face of each drum end being accessible through said aperture on a correspondingly positioned one of said lateral faces, an elongated coil being flexible and having one end extending into said magazine and being retained by said drum and a portion of its length rotatable about said drum in supported relation thereon, an opposite end of said coil including a fixedly secured head, said head and the end of the coil attached thereto extending outwardly from said cannister assembly, (d) a handle assembly having an elongated configuration and a hollow interior extending along the length thereof, said handle assembly rotatably mounted to said cannister assembly so as to extend outwardly from a peripheral surface thereof in a direction substantially parallel to said lateral faces, said handle assembly disposed in surrounding relation to a length of said coil protruding outwardly from said cannister assembly, (e) said coil movable between an operable position and a stored position, said operable position being defined by said head and a length of said coil extending outwardly from said cannister and said handle assembly into operative engagement with a drain being cleaned; said stored position defined by a majority of the length of said coil being supported in surrounded relation about said drum, (f) said drum and said coil operatively interconnected such that said coil is movable between said stored and said operable position upon rotation of said drum relative to said cannister assembly.

18. A retainer as in claim 17 wherein said drum comprises a grip assembly formed on each of said exposed ends of said drum halves, said grip assembly having a recessed structural configuration and a plurality of outwardly projecting ribs mounted in said recessed construction and spaced apart from one another so as to provide gripping engagement by the hand of a user therewith.

* * * * *